US009366111B2

(12) United States Patent
Verma et al.

(10) Patent No.: US 9,366,111 B2
(45) Date of Patent: Jun. 14, 2016

(54) METHOD FOR ACTIVE COOLING OF DOWNHOLE TOOLS USING THE VAPOR COMPRESSION CYCLE

(75) Inventors: Sandeep Verma, Acton, MA (US); John G. Brisson, Rockport, MA (US); Eric L. Stabinski, Brookline, MA (US); Quincy K. Elias, Mattapan, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 688 days.

(21) Appl. No.: 13/298,123

(22) Filed: Nov. 16, 2011

(65) Prior Publication Data

US 2012/0125614 A1 May 24, 2012

Related U.S. Application Data

(60) Provisional application No. 61/415,540, filed on Nov. 19, 2010.

(51) Int. Cl.
*E21B 36/00* (2006.01)
*E21B 47/01* (2012.01)

(52) U.S. Cl.
CPC ..... *E21B 36/001* (2013.01); *E21B 47/011* (2013.01)

(58) Field of Classification Search
CPC ..... E21B 36/00; E21B 36/001
USPC ..... 166/57, 302
See application file for complete search history.

(56) References Cited

U.S. PATENT DOCUMENTS 3,435,629 A * 4/1969 Hallenburg ..... 62/259.1
4,467,621 A * 8/1984 O'Brien ..... 62/324.1
5,020,320 A * 6/1991 Talbert et al. ..... 62/238.7
5,099,651 A * 3/1992 Fischer ..... 62/79
5,701,751 A * 12/1997 Flores ..... 62/169
6,769,487 B2 * 8/2004 Hache ..... 166/302
6,978,828 B1 12/2005 Gunawardana
7,231,775 B2 * 6/2007 Dilk et al. ..... 62/235
7,428,925 B2 * 9/2008 Brown et al. ..... 166/264
2004/0112601 A1 * 6/2004 Hache ..... 166/302
2005/0097911 A1 5/2005 Revellat et al.
2005/0257533 A1 11/2005 Gunawardana et al.

(Continued)

OTHER PUBLICATIONS

"Design of Vapor-Compression Refrigeration Cycles" Published Sep. 7, 2002. http://www.qrg.northwestern.edu/thermo/design-library/refrig/refrig.html.*

(Continued)

*Primary Examiner* — Robert E Fuller
*Assistant Examiner* — David Carroll
(74) *Attorney, Agent, or Firm* — Jakub Michna

(57) ABSTRACT

A method of and apparatus for cooling equipment including exposing a fluid to a tool comprising electronic components at a temperature T and pressure P, compressing the fluid to a temperature T1 and pressure P1, exposing the fluid to a surface in communication with liquid or gas or both external to the tool wherein the fluid after exposure to the surface is at a temperature T2 and pressure P2, and allowing the fluid to expand to a temperature T3 and pressure P3 wherein the equipment is a tool in a subterranean formation and T is less than T2 and P is less than P2. Apparatus and methods for cooling oil field services tools including a fluid that conducts heat from the tool to the fluid, a compressor that, a heat exchanger that accepts fluid from the compressor and that rejects heat from the fluid, and a valve or orifice.

17 Claims, 8 Drawing Sheets

(56) References Cited

U.S. PATENT DOCUMENTS

| | | | | |
|---|---|---|---|---|
| 2006/0213660 | A1 | 9/2006 | DiFoggio et al. | |
| 2006/0213669 | A1 | 9/2006 | Shipley et al. | |
| 2008/0223579 | A1 | 9/2008 | Goodwin | |
| 2009/0272129 | A1* | 11/2009 | Petty | 62/64 |
| 2010/0242534 | A1 | 9/2010 | Stockton, Jr. | |
| 2011/0146967 | A1 | 6/2011 | Winslow | |
| 2013/0104572 | A1* | 5/2013 | DiFoggio | 62/56 |

OTHER PUBLICATIONS

International Search Report and Written Opinion of PCT Application No. PCT/US2011/061243 dated Nov. 5, 2012.

* cited by examiner

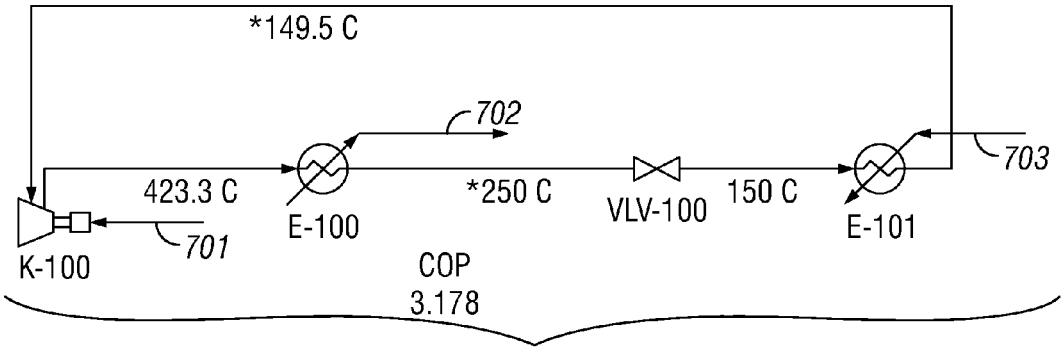
FIG. 7
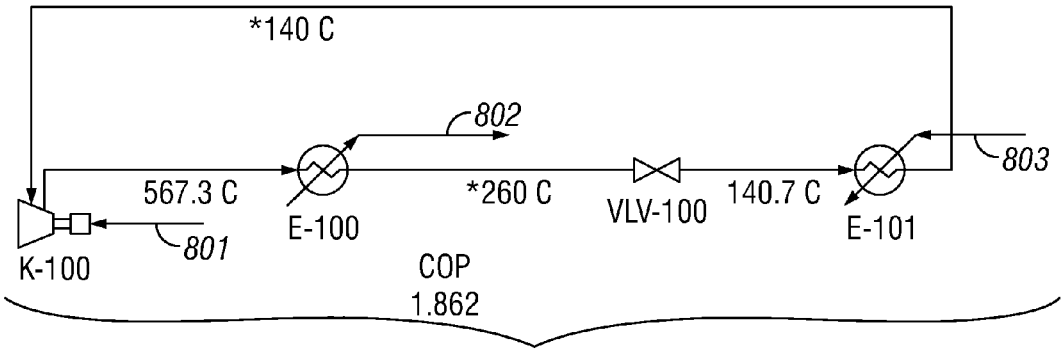
FIG. 8
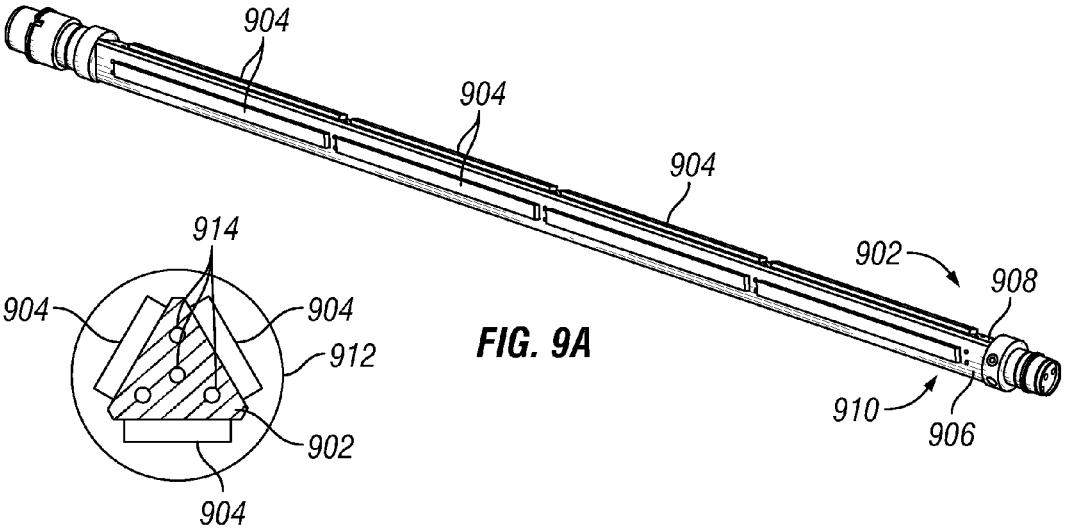
FIG. 9A
FIG. 9B

METHOD FOR ACTIVE COOLING OF DOWNHOLE TOOLS USING THE VAPOR COMPRESSION CYCLE

CROSS-REFERENCE TO RELATED APPLICATION

This application claims benefit of U.S. Provisional Patent Application Ser. No. 61/415,540, filed on Nov. 19, 2010, and entitled, "Method for Active Cooling of Downhole Tools Using the Vapor Compression Cycle," which is incorporated by reference herein in its entirety.

FIELD

Embodiments described herein generally relate to methods, systems and apparatus for using the vapor compression cycle in the active cooling of downhole tools and equipment. Embodiments of the present invention may be utilized in oil, gas, geothermal, water, and $CO_2$ wells, as well as any subsurface application known to one skilled in the art.

BACKGROUND

The oil and gas exploration and production industry is likely to drill and produce deeper and hotter wells, with wells with a reservoir temperature above 150° C. forecast to increase. In general, these types of wells are considered a high pressure high temperature, or HPHT, environments. In addition, an increasing number of Ultra HPHT (high pressure high temperature with the temperature above 205° C.) wells are likely to be drilled in the future. Using conventional technologies, downhole tools experience high failure rates at temperatures above 160° C. At this time, there is a limited catalog of electronic components which can reliably operate above 150° C. Therefore, providing active/passive cooling for electronics is one of the options for extending the operation and reliability of downhole tools such that they may be more effectively used in HPHT and Ultra-HPHT regimes.

Passive methods of cooling downhole tools provide cooling for a short duration as they provide a fixed capacity for heat absorption from the tool. If the tool is likely to be exposed to HPHT or ultra HPHT conditions for long duration, then active cooling methods need to be used. Active cooling methods use electric power to reject heat absorbed from the tool at lower temperatures to the wellbore fluid (or the formation) at a higher temperature.

SUMMARY

Embodiments relate to a method of and apparatus for cooling equipment including exposing a fluid at a temperature T and pressure P to a surface in communication with electronic components mounted on a tool chassis, compressing the fluid to a temperature T1 and pressure P1, exposing the fluid to a surface in communication with liquid or gas or both external to the tool wherein the fluid after exposure to the surface is at a temperature T2 and pressure P2, and allowing the fluid to expand to a temperature T3 and pressure P3 wherein the equipment is a tool in a subterranean formation and T is less than T2 and P is less than P2. Embodiments relate to an apparatus and methods for cooling oil field services tools including a tool that is in communication with a fluid that conducts heat from the tool to the fluid, a compressor that accepts fluid from the tool, a heat exchanger that accepts fluid from the compressor and that rejects heat from the fluid to the surrounding fluid or formation, and a valve or orifice to accept fluid from the compressor and to return fluid to the chassis within the tool wherein the compressor is controlled by a controller and the controller accepts temperature information from the tool and the surrounding fluid or formation. Embodiments relate to a method and apparatus for cooling an oil field services tool including exposing a fluid to a tool comprising electronic components, compressing the fluid in a compressor, exposing the fluid to a surface in communication with liquid or gas or both external to the tool, allowing the fluid to expand, and controlling the compressor using a temperature of the liquid or gas or both external to the tool. In some embodiments, the compressor includes a variable frequency drive and/or a temperature measurement of the surrounding formation and/or wellbore. In some embodiments, the fluid is water, brine, drilling mud, and/or formation fluid. In some embodiments, the fluid is paste, liquid, and/or pressurized gas.

BRIEF DESCRIPTION OF THE DRAWINGS

FIG. 7 is an Aspen HYSYS simulation of an ideal VCC.

FIG. 8 is an Aspen HYSYS simulation of a practical VCC.

FIG. 9A shows a delta chassis with electronic components mounted to the chassis and FIG. 9B shows a cross-sectional view of the delta chassis located within a tool housing.

DETAILED DESCRIPTION

Figure 1:
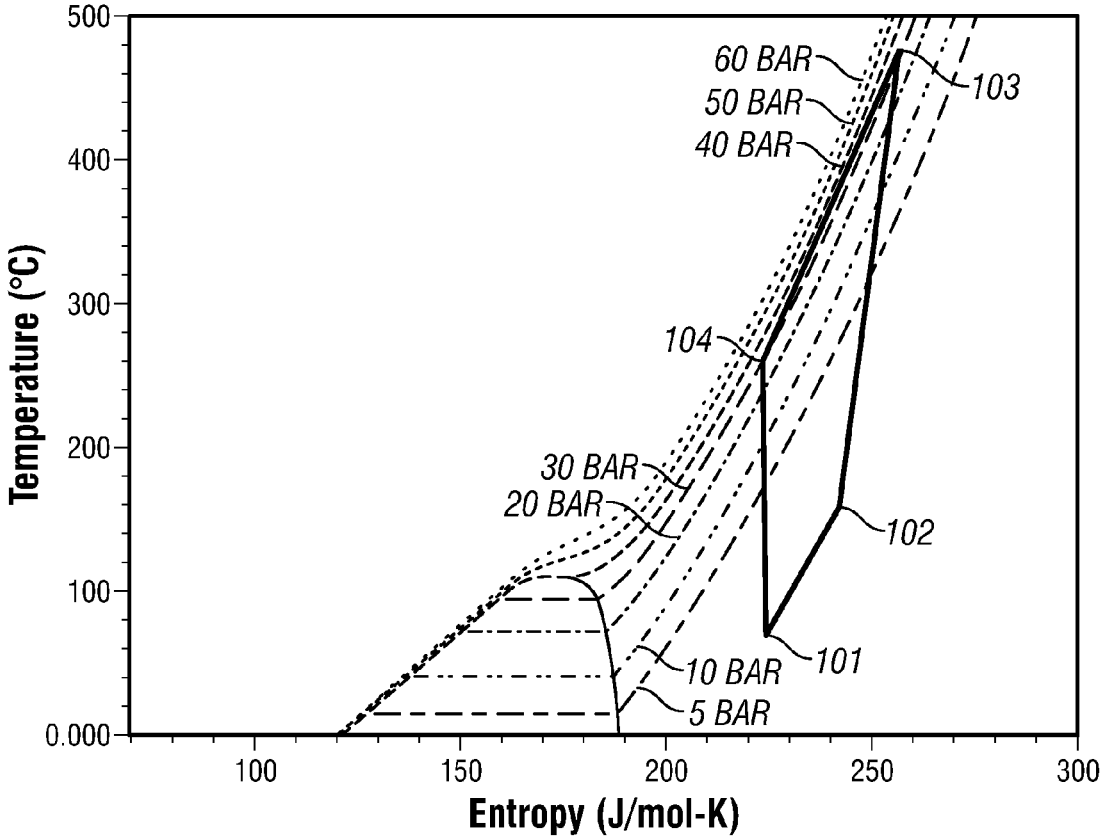
FIG. 1 is a thermodynamic representation of the reverse-Brayton cycle.

The techniques used for cooling downhole tools in high temperature environments may be broadly classified in two—passive cooling and active cooling.

Passive Cooling

As the name suggests, this class of thermal management does not use energy or electric power to provide cooling. Commonly vacuum jacketed pipes, high insulation materials, and phase change materials are used for reducing heat ingress from the high temperature environment of the wellbore while providing a mechanism for cooling the components inside the tool body. However, this strategy can only provide limited cooling capacity for tools in a high temperature environment. It is a useful strategy for some downhole tools that are only deployed for a short duration. However, for certain tools that have longer mission profiles at high temperatures, the options for avoiding failure of electronic boards are either providing active cooling of standard electronic components or specially designed high temperature electronic components.

Active Cooling

It is useful to define the problem in standard terms. Consider Tc as the temperature at which we need to maintain the tool, while the wellbore temperature is Th. Let Q is sum of the rate of heat leaked through the housing to the tool and the rate of heat generated on the chassis (where the electronic components are mounted), and W is the rate of work done on the system. It is possible to construct a thermodynamic cycle (commonly referred to as a heat pump) to absorb heat Qc at a cold temperature Tc and reject it at higher Th using W as the work done. Note that the Clausius statement of the second law of thermodynamics states that heat generated cannot spontaneously flow from a material at a lower temperature to a material at a higher temperature. Therefore, any embodiment of a strategy to absorb heat continuously at Tc and rejecting it at Th will require input work or electric power.

It is important to choose the most appropriate thermodynamic cycle and working fluid for absorption of heat from the tool and dissipation of heat to the drilling mud. It would be appropriate to choose a thermodynamic cycle with the highest possible efficiency so that the power consumption downhole is minimized.

There are several techniques that may be used to provide this cooling. These include thermoelectric devices, sterling or pulse tube refrigerators, thermoacoustic coolers and our cycle of choice, the vapor compression cycle. Thermoelectric devices are generally used for local area cooling/heating and generally have low coefficient of performance (COP, defined as Qc/W). Thermoacoustic coolers, sterling cryocoolers and pulse tube refrigerators can all be described using the reverse-Brayton cycle (shown in FIG. 1) as each of these processes includes the following steps.

1. Adiabatic compression of the gas. The fluid is adiabatically compressed using shaft work Ws with a concomitant temperature increase at stage 3 to a temperature higher than Th.
2. Isobaric heat transfer. At constant pressure, the fluid is cooled in a heat exchanger to a temperature T4 after rejecting heat Qh to the ambient.
3. Adiabatic expansion. The fluid is expanded either across a turbine or a piston at constant entropy. This expansion cools the fluid to temperature T1, which is less than Tc.
4. Isobaric heat transfer. As the fluid temperature is less than Tc, it absorbs heat Qc from the source, gradually increasing the fluid temperature to T2, which is just below Tc.

FIG. 1 provides a thermodynamic representation of the reverse-Brayton cycle. Line 101 is cooled fluid, line 102 is after heat pickup, line 103 is compressed fluid and line 104 is after heat rejection.

This cycle, as described is completely reversible as both compression and expansion are reversible. Therefore, it is the perfect embodiment of an ideal heat pump. Consider Tc=150° C. and Th=250° C. For a heat pump, the ideal or Carnot COP is defined as Tc/(Th−Tc)=4.12 for our process.

Figure 2:
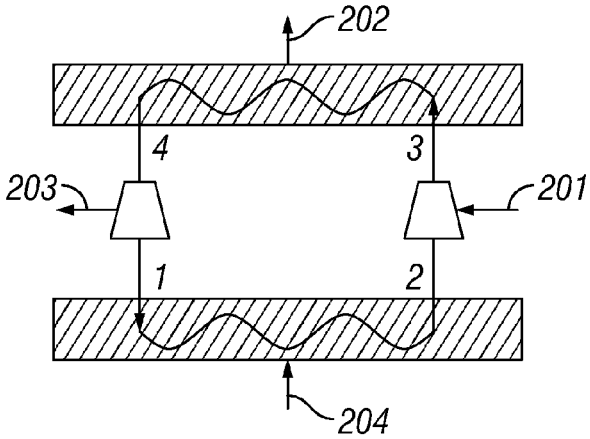
FIG. 2 is a schematic of the reverse-Brayton cycle.

FIG. 2 is a schematic of the reverse-Brayton cycle. 201 represents work input, $W_s$, 202 represents heat rejected, $Q_h$, $T_h$, 203 represents isentropic expansion, and 204 represents heat absorbed, $Q_c$, $T_c$.

Figure 3:
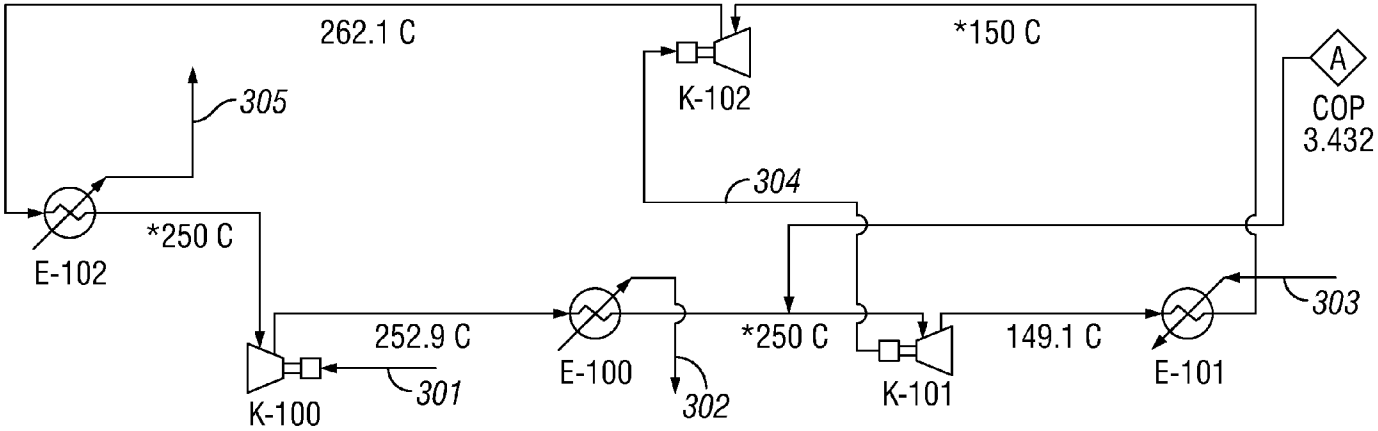
FIG. 3 is an Aspen HYSYS simulation of an ideal reverse-Brayton cycle.

We simulated the above process using a process simulator Aspen HYSYS. The simulation results are shown in FIG. 3. FIG. 3 is an Aspen HYSYS simulation of an ideal reverse-Brayton cycle. The following table summarizes some components of the figure.

| | Title | Heat Flow [W] |
|---|---|---|
| 301 | Power In | 50.58 |
| 302 | To Drilling Mud | 42.73 |
| 303 | Tool Heat | 173.6 |
| 304 | Shaft Power | 374.0 |
| 305 | To Drilling Mud 2 | 181.4 |

Allowing for a tool heat pickup of 173.6 W at 150° C., we chose a temperature at T1 of 149.1° C. (since we needed a temperature below 150° C. for sensible heat transfer to the fluid). We assumed an ideal heat exchanger with the outlet fluid stream after absorbing heat from the tool at 150° C. We also assumed an ideal exchanger for cooling the compressed gas stream (T3 to T4 being 262.1° C. to 250° C., and 252.9° C. to 250° C.), which is compressed in two stages. The first stage of compression uses the work recovered in expansion of the gas stream from stage 4 to stage 1 and the second stage of compression uses an electric motor driven compressor (with input power Ws). The expansion across expander K-101 is considered to be ideal with an adiabatic efficiency of 100%.

This cycle is thus simulated to be as ideal as possible in a conventional simulator. The calculated COP for this process is 3.432, which is close to the Carnot COP of 4.12. In principle, a COP of 4.12 should be achievable if we increase the temperature at stage T1 from 149.1 to as close to 150° C. as possible. Practically, it would entail a much higher flow rate and an extremely large ideal heat exchanger E-101. The current example suffices to prove our point that, theoretically, the reverse-Brayton cycle and its many manifestations as sterling, pulse tube or thermoacoustic coolers are the most efficient heat pump cycle.

Figure 4:
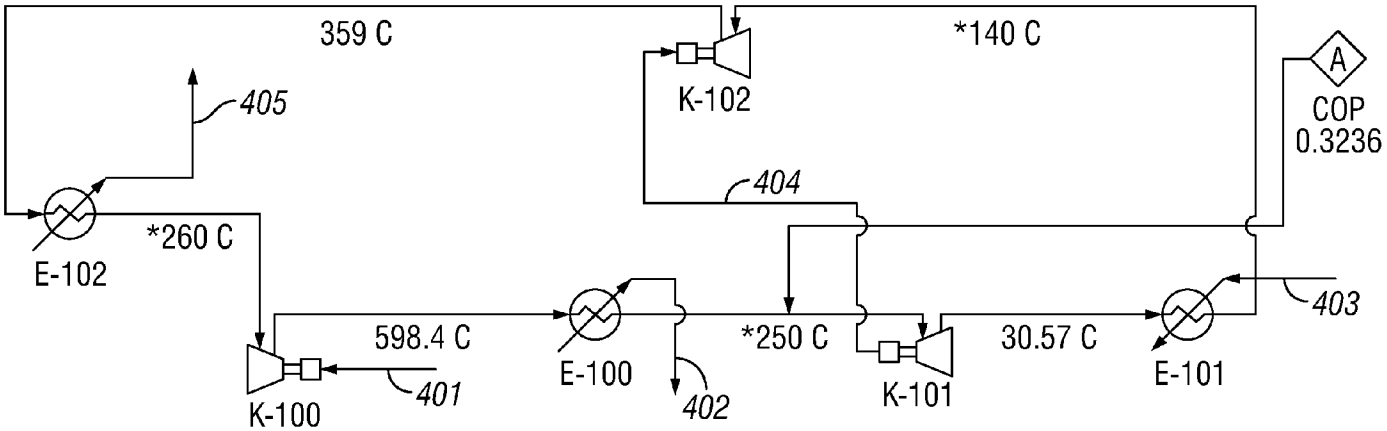
FIG. 4 is an Aspen HYSYS simulation of a practical reverse-Brayton cycle.

However, in a practical manifestation of this cycle, shown in FIG. 4, it is clear that the practical COP achievable is nowhere close to the theoretically estimated COP or the Carnot COP.

FIG. 4 is an Aspen HYSYS simulation of a practical reverse-Brayton cycle. The following table summarizes some components of the figure.

| | Title | Heat Flow [W] |
|---|---|---|
| 401 | Power In | 391.2 |
| 402 | To Drilling Mud | 403.2 |
| 403 | Tool Heat | 126.6 |
| 404 | Shaft Power | 253.0 |
| 405 | To Drilling Mud 2 | 114.5 |

In this cycle, we chose Argon as the working fluid. T1 was chosen as 30.57° C. to get a reasonable flow rate for Argon. After heat pickup of 126.6 W from the tool, the temperature increased to 140° C., an approach of 10° C. to Tc of 150° C., so that we may be able to design a reasonable heat exchanger. The compressor and the expander adiabatic efficiencies were fixed at 75%, which is realistic. Fluid temperatures after rejecting heat to the wellbore at 250° C. were set at an approach of 10° C., to 260° C.

The COP for this practical cycle was calculated to be only 0.3236, almost a factor of ten below the ideal cycle and less than 10% of the Carnot COP.

As discussed previously, we selected the vapor compression cycle, or VCC. The vapor compression cycle is shown in red lines in the T-S space in FIG. 5. FIG. 4 provides a thermodynamic representation of a Vapor Compression cycle with the following reference numerals.

Figure 6:
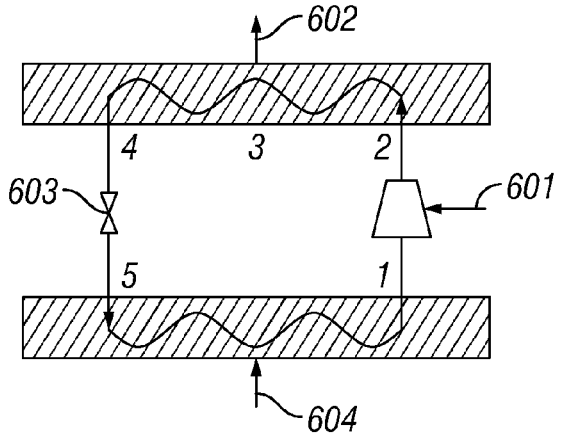
FIG. 6 is a schematic of a Vapor Compression Cycle.

501 Saturated Vapor
502 Superheated Vapor
503 Saturated Vapor
504 Saturated Liquid
505 Liquid+Vapor A schematic for this cycle is also shown in FIG. 6, with the numbered stages corresponding to those shown on the T-S phase diagram in FIG. 1 with the following reference numerals.

Figure 5:
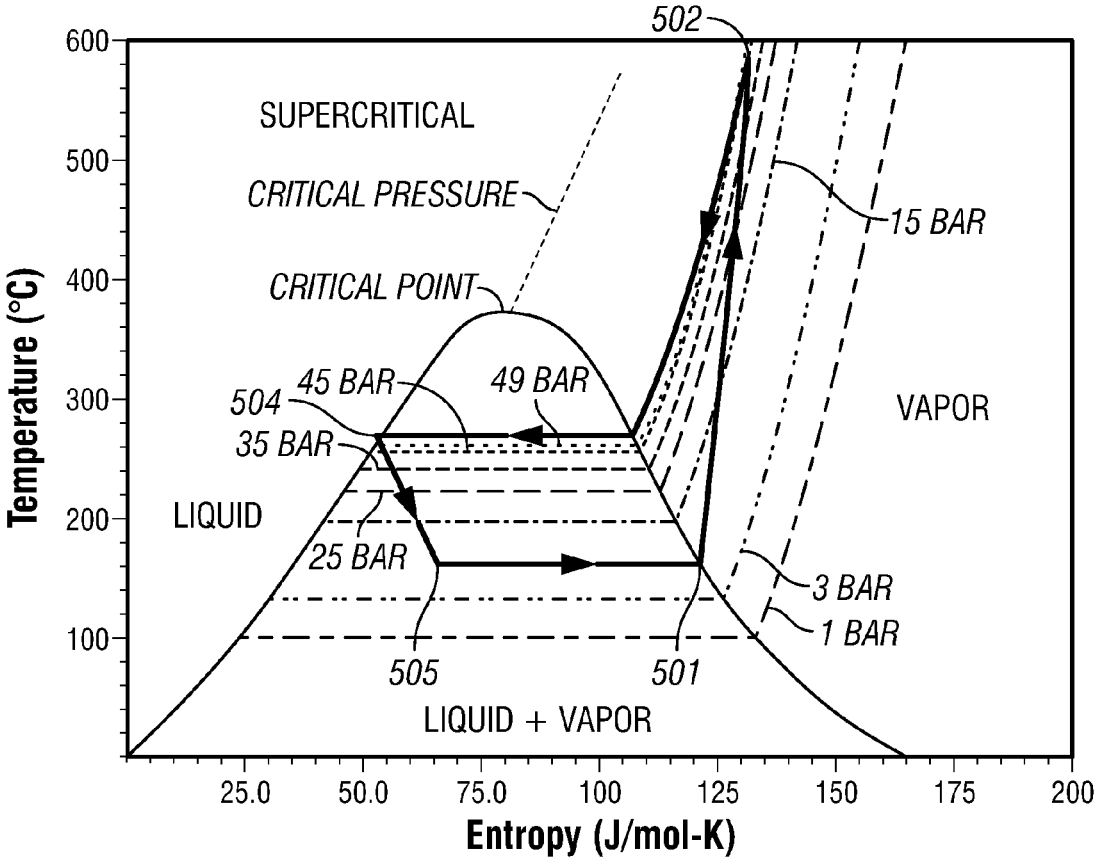
FIG. 5 is a view of a thermodynamic representation of a Vapor Compression cycle.

601 Work Input, $W_s$
602 Heat rejected, $Q_h$, $T_h$
603 Isenthalpic, $W_s$=0
604 Heat absorbed, $Q_c$, $T_c$ Starting at stage 1, or saturated vapor, the fluid is compressed using a suitable compressor to point 2, labeled "Superheated Vapor". This process requires work input, shown as Ws in FIG. 6. Note that, in this example, the compression is shown as occurring in a single stage for simplicity. In practice, this compression is likely to be in several stages. At point 2, the temperature of the fluid is higher than the elevated ambient temperature. Therefore, using a suitable heat exchanger, the temperature of the fluid may be cooled close to the ambient temperature $T_h$. The fluid needs to chosen such that it exists as a saturated vapor at these conditions. Pressure for stage 2 is chosen such that the fluid exists as a saturated vapor at pressure P2 (pressure at stage 2), and temperature $T_h$ (temperature at stage 3 and 4). The fluid continues to cool beyond this point to stage 4, or to the saturated liquid stage. In a single phase, transition from saturated vapor to saturated liquid takes place at a constant temperature, shown in FIG. 5 as a horizontal line between stage 3 and 4. The fluid is then iso-enthalpically expanded across a valve and the pressure drops to P5 (which is same as P1). The temperature of the expanded fluid drops to T5, which is a few degrees below Tc to facilitate heat pickup from the tool maintained at Tc. At stage 5, the fluid exists as a vapor-liquid mixture, which is mostly liquid. As mentioned before, the amount of liquid in this mixture may be estimated by using the lever rule within the boundaries of the bell shaped curve that defines the saturated liquid and the saturated vapor curves. As the fluid picks up heat (or cools the electronic chassis on the tool), the relative amount of vapor increases in this vapor-liquid mixture. The heat rejected by the downhole tool is absorbed as the latent heat of vaporization so the heat pickup by the fluid occurs at a constant temperature. At the end of the heat pickup, at stage 1, the fluid has no liquid phase left and is shown in FIG. 5 on the saturated vapor curve. This cycle is then repeated as the tool is continuously cooled.

An ideal version of this cycle was simulated using Aspen HYSYS and the results are shown in FIG. 7. FIG. 5 is an Aspen HYSYS simulation of an ideal VCC with the following reference numerals and heat flows.

| | Title | Heat Flow [W] |
|---|---|---|
| 701 | Power In | 34.84 |
| 702 | To Drilling Mud | 145.5 |
| 703 | Tool Heat | 110.7 |

In this instance, the compressor adiabatic efficiency was assumed to be 100% and the heat exchangers were assumed to be 100% efficient, as for the ideal reverse-Brayton cycle. The ideal cycle COP is calculated to be 3.178, lower than the ideal reverse-Brayton cycle COP as expansion across the valve VLV-100 is not adiabatic (or iso-entropic of reversible). It is iso-enthalpic, or, in other words, there is loss of entropy associated with this process. About 110.7 W of heat are absorbed from the tool for this simulation.

A practical version of this cycle was simulated using Aspen HYSYS and the results are shown in FIG. 8. FIG. 8 provides an Aspen HYSYS simulation of a practical VCC with the following reference numerals and heat flows.

| | Title | Heat Flow [W] |
|---|---|---|
| 801 | Power In | 57.28 |
| 802 | To Drilling Mud | 163.9 |
| 803 | Tool Heat | 106.6 |

The compressor K-100 adiabatic efficiency was set at 75% and a 10° C. approach was used for all heat exchangers. The temperature of stream 4 (past the heat exchanger E-100) is cooled to 260° C. as Th is at 250° C. The two-phase fluid, stream 5 is introduced to the tool heat exchanger (e-101) at 140.7° C. It picks up 106.6 W of heat from the tool. The COP for this cycle is calculated to be 1.862, or 45.2% of the Carnot COP.

Therefore, it is obvious from the preceding discussion that although the reverse-Brayton cycle represents the highest achievable COP for an ideal cycle, for a practical thermodynamic cycle using components with reasonable efficiencies, the VCC represents the best option for cooling downhole tools.

Several versions of downhole cooling cycles are discussed for cooling downhole tools in U.S. Pat. No. 5,701,751, U.S. Pat. No. 6,769,487, U.S. Pat. No. 6,978,828 which are incorporated by reference herein.

This discussion is directed toward methods, systems and apparatus for active cooling of downhole tools using the vapor compression cycle. Additional methods, systems, apparatus for active cooling of downhole tools using the vapor compression cycle are further detailed in a section below entitled "Example Implementations." These recited additional features, systems, methods and/or apparatus represent a non-exhaustive potential implementation and are recited for illustrative purposes.

Refrigerant Choice

The choice of a suitable refrigerant for this cycle requires a fundamental thermodynamic analysis. Most Freon based refrigerants commonly used for room temperature cooling are not suitable as they have low critical temperatures. For this particular application, it is useful to examine this cycle in the Temperature-entropy (or the T-S) space, shown in FIG. 5. The region to the left of the blue curve is labeled as "Liquid". The fluid exists as a liquid in this space, as a saturated liquid on the blue curve and as subcooled liquid to the left of the blue curve. Under the bell shaped curve, identified by the blue curve to the left and the cyan curve to the right, is the two-phase region, identified as the "Liquid+Vapor" space. Isobaric, or constant pressure curves are shown, starting in this region and extending into the "Vapor" region on the right of the cyan curve. As we move along an isobaric curve from the blue, or the saturated liquid curve, to the cyan or the saturated vapor curve, the relative fraction of vapor increases from zero to 100%. At any intermediate point, the relative amount of liquid or vapor may be calculated using the lever rule. At the apex of the bell shaped curve, is a point labeled the "Critical Point". This represents the maximum or critical temperature (in the T-S space) at which the vapor and liquid phases may coexist. There is an equivalent pressure, referred to as the critical pressure, above which the two phase region does not exist. This critical pressure curve is shown on FIG. 5 as a dotted cyan curve.

In this cycle, there are several constraints on the choice of a fluid. Some of these are listed below.

1. The critical temperature should be greater than the highest temperature where we wish to deploy these tools, preferably with a safety margin of approximately 50° C.
2. The triple point, or where the fluid may form a solid, should be at least approximately 50° C. below Tc, or the temperature where we wish to cool the tool.

We then conducted a search on fluids with a critical temperature between 300-1000° C. and a Triple point temperature below 100° C. The fluids with such properties include water, duodecane, propylcyclohexane, decane, methyl linoleate, methyl linolenate, methyl oleate, methyl palmitate, methyl stearate, nonane, toluene and heavy water. Of these fluids, water is the environmentally friendly, available freely and has a high latent heat of vaporization. Therefore, for our purpose, we choose this fluid for the vapor compression cycle.

Experimental Implementation

This thermodynamic cycle was demonstrated in a wireline tool. FIG. 9A shows a delta chassis 902 with electronic components mounted 904 to the chassis. The electronic circuit boards 904 are mounted on three rectangular outer faces 906, 908, 910 of a triangular tube chassis (also called the delta chassis) 902. The delta chassis 902 is segmented into four zones with three faces per zone and four faces per side as shown in FIG. 9A.

Heating elements and thermocouples were installed on these faces to simulate heat generated from electronic components during operation. The chassis 902 is wired up with a thermocouple on each face and a 64 Watt heater around each Zone. These heaters are wired together in parallel and are controlled by a variable transformer to give a total distributed heat load across the delta chassis ranging from 30-190 W.

FIG. 9B shows a cross-sectional view of the delta chassis 902 located within a tool housing 912 of the wireline tool. The delta chassis 902 is made of 6061/6063 aluminum with four flow lines 914 going through the body for refrigerant circulation. The refrigerant lines are shown in FIG. 9B by the holes shown on the enlarged end view. The orientation of the coolant flow lines 914 is such that flow can go along the three outer lines and return through the center line.

To simulate the high-temperature downhole environment, the chassis is put inside a vacuum insulated pipe, and the pipe is heated to simulate heating from the formation in which the tool may be operating. The pipe is heated by two 4.5 ft jacket heaters.

Figure 10:
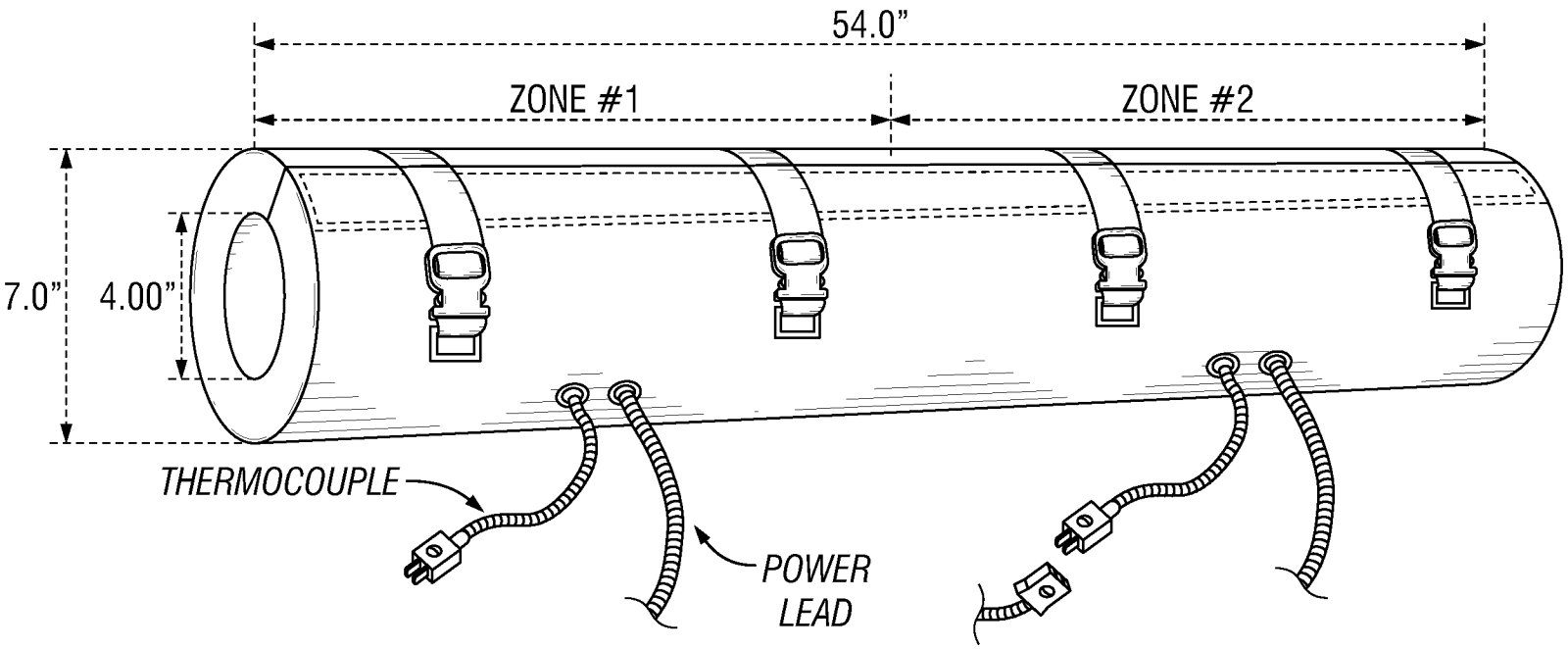
FIG. 10 is a figure drawing of a heating jacket.

As shown in FIG. 10, each heater is broken up into two zones for individual temperature control of each zone. Both heaters are rated at 1200 W. These heaters are controlled by a temperature controller. The cooling system is designed to provide compressed steam (as a refrigerant) to cool the delta chassis. An expansion valve was used to allow the steam to decompress as it enters the system.

During operation, the system operates with the internal fluid temperature maintained at 140° C. The system is charged with water to 38.3 psig, corresponding to saturated vapor/liquid conditions at 140° C. for water, and the external heating jackets are turned on.

In order to demonstrate the feasibility of the vapor compression cycle, testing has been done for the two temperatures, 200° C., and 250° C. When the refrigerant is able to absorb the heat that is being generated on the chassis, the zone temperatures remain close to 140° C., the saturated temperature of steam at 38 psig, the pressure in the chassis tubes. Once the chassis generated heat load exceeds the ability of the refrigerant to absorb the heat, Zone 4 begins to increase in temperature and the other Zones 3, 2 and 1 subsequently follow suit. The experimental results are shown in FIGS. 11, 12, 13 and 14.

Figure 11:
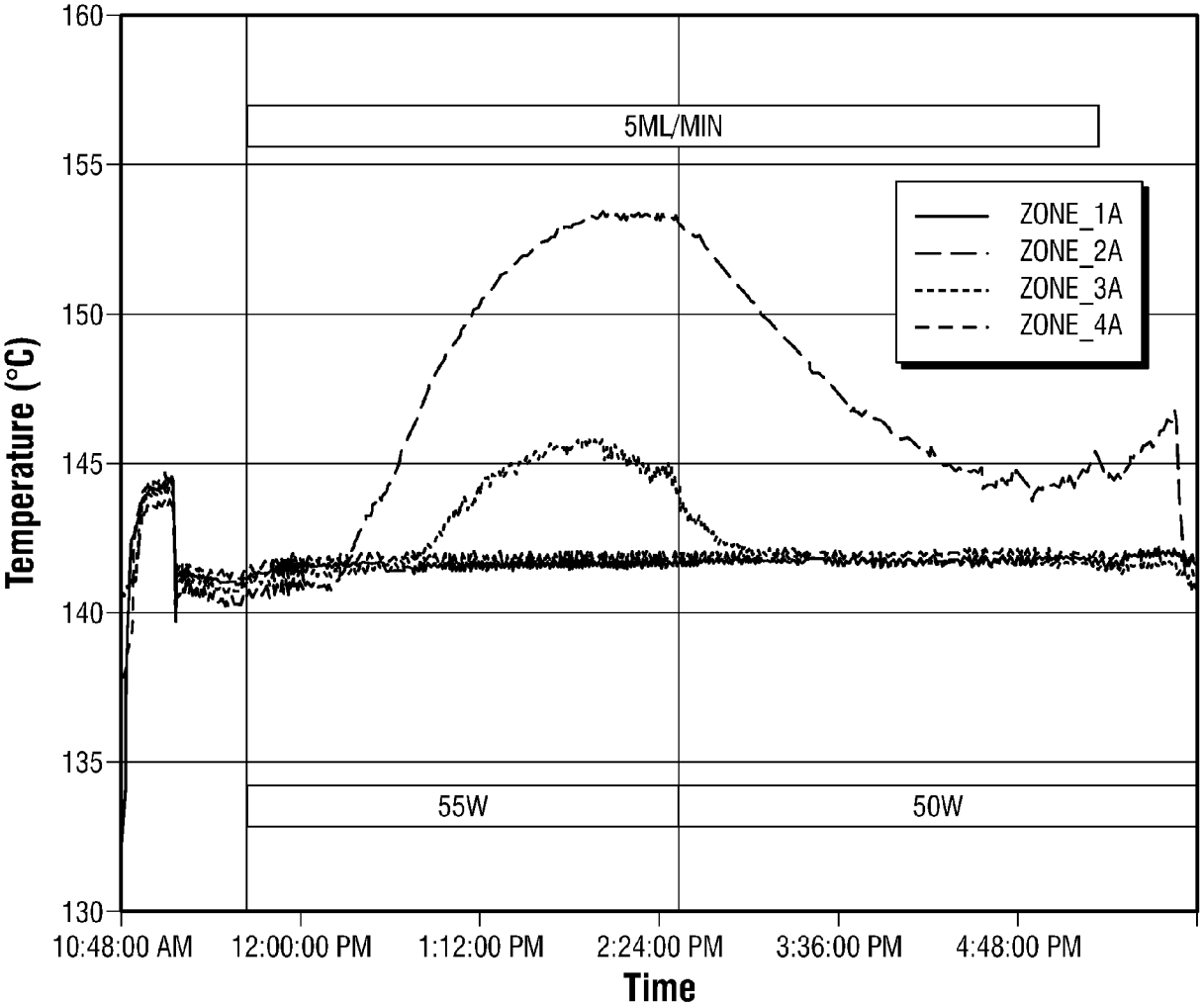
FIG. 11 is a plot of chassis temperature as a function of time for a steam inlet pressure of 307 psig and a jacket temperature of 200° C.

FIG. 11 shows the temperatures in the four zones of the chassis as a function of time. The steam flow rate is set at 5 ml/min and the jacket temperature is maintained at 200° C. Steam is introduced at a pressure of 307 psig to the expansion valve. At a time before 12:00 p.m., the four zonal temperatures could be maintained at close to 140° C. with this flow rate of steam. At 12:00 p.m., 55 W of heat was applied to the chassis using resistive heaters. As can be seen from the graph, it was not possible for to keep the chassis temperatures constant, and Zone 4A temperature started increasing shortly thereafter. After a few minutes, Zone 3A temperature also started increasing. The heat generated on the chassis was decreased to 50 W at 2:24 p.m. and all zonal temperatures started to ramp down to the original temperatures, close to 140° C. Therefore, for this experiment, we conclude that 50 W of heat generated on the chassis, in addition to heat leaked from the outer jacket through the vacuum jacketed pipe, can be absorbed by a steam flow rate of 5 ml/min.

Figure 12:
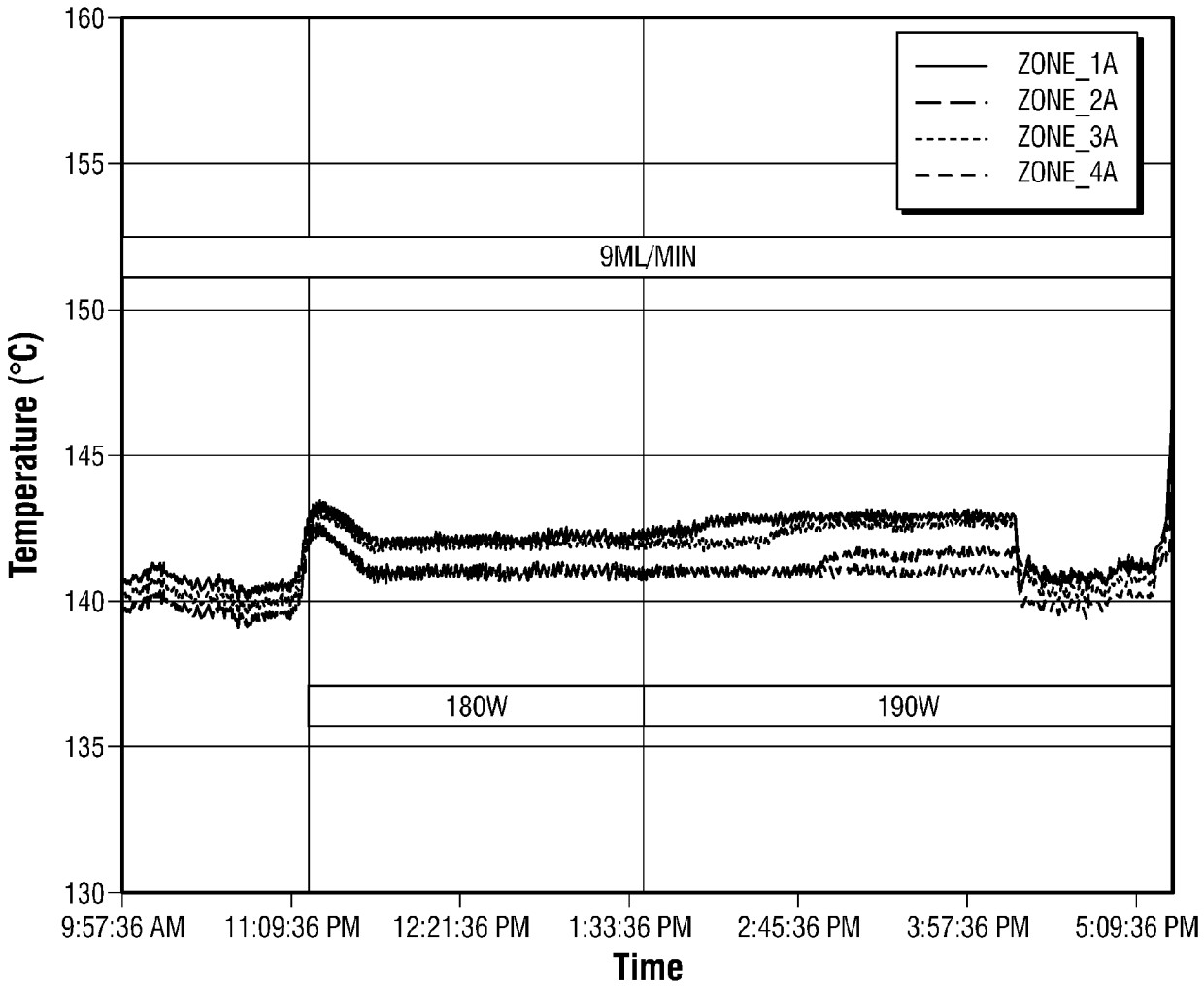
FIG. 12 is a plot of a chassis temperature as a function of time for a steam inlet pressure 360 psig and a jacket temperature of 200° C.

The conditions are identical (to those in FIG. 11) for the next experiment, shown in FIG. 12. Steam inlet pressure was set at 360 psig. Under these conditions, the temperatures of the four zones are maintained close to 140° C. A heat load of 190 W was applied to the chassis and the chassis temperatures remained constant. Therefore, with a steam flow rate of 9 ml/min, a minimum of 190 W can be absorbed from the chassis, in addition to heat leaked from the outer jacket.

Figure 13:
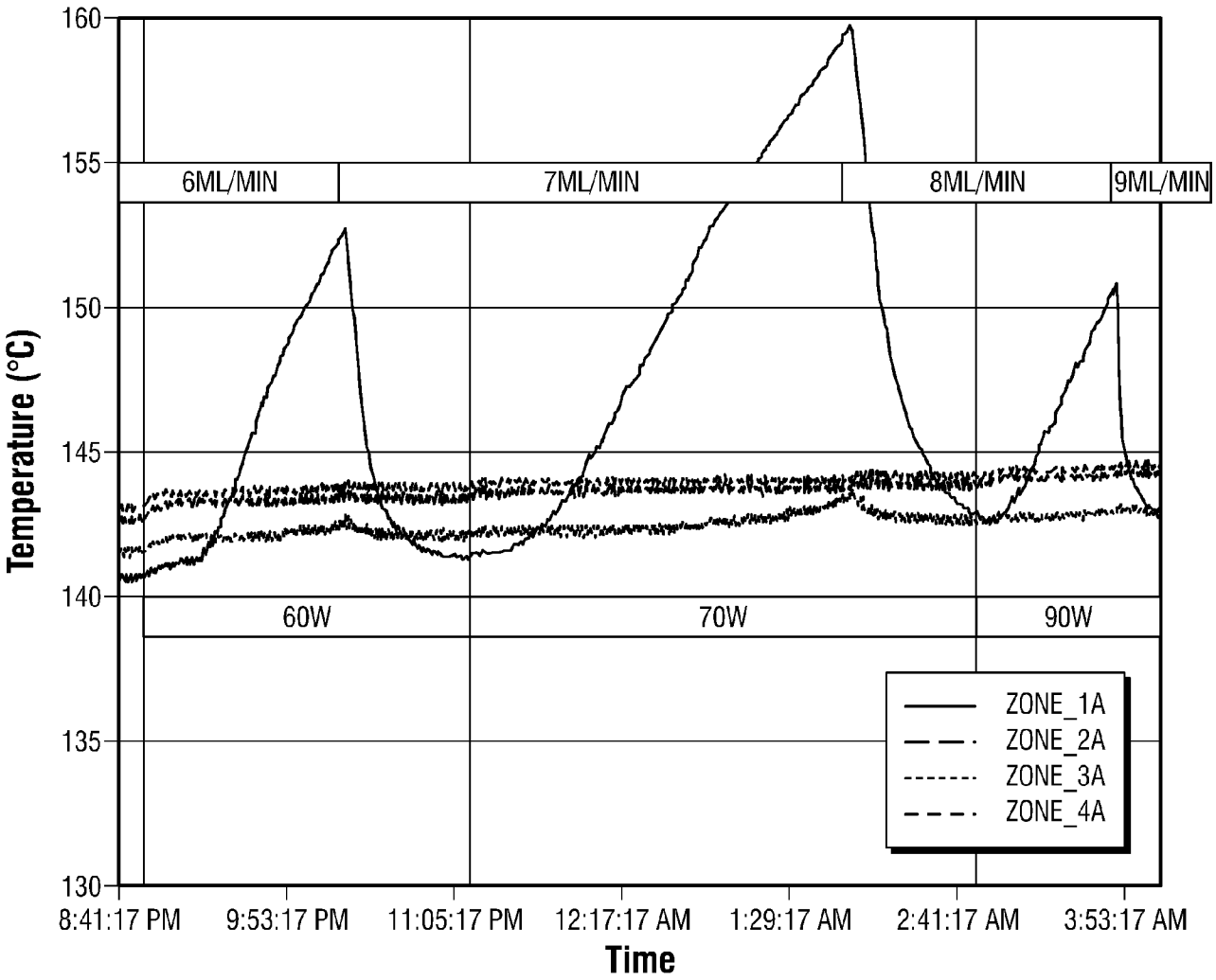
FIG. 13 is a plot of a chassis temperature as a function of time for a steam inlet pressure 480 psig and a jacket temperature of 250° C.

FIG. 13 shows the temperature versus time profile for chassis thermocouples for an ambient temperature of 250° C. Steam was introduced at a pressure of 480 psig. As is clear from this graph, 60 W of chassis generated heat (plus heat flux through the vacuum-jacketed pipe) can be absorbed with a steam flow rate of 7 ml/min and 70 W of chassis generated heat (plus heat flux through the vacuum-jacketed pipe) can be absorbed with a steam flow rate of 8 ml/min.

We claim:

1. A method of cooling electronic components in an oilfield services tool using the vapor compression cycle, the method comprising:

passing a fluid at a temperature T and pressure P along a flow line, wherein the flow line passes through a body of a tool chassis located within a housing of the oilfield services tool, the electronic components are mounted to at least one outer face on the body of the tool chassis, and heat is conducted from the body of the tool chassis to the fluid;

after passing the fluid through the body of the tool chassis, compressing the fluid to a temperature T1 and pressure P1;

exposing the fluid to a surface in thermal communication with liquid or gas or both external to the tool, wherein the fluid after exposure to the surface is at a temperature T2 and pressure P2; and allowing the fluid to expand to a temperature T3 and pressure P3;

wherein T is less than T2 and P is less than P2.

2. The method of claim 1, wherein the fluid comprises water.

3. The method of claim 1, wherein the fluid is selected from the group consisting of brine, drilling mud, and formation fluid.

4. The method of claim 1, wherein the fluid is selected from the group consisting of paste, liquid, and pressurized gas.

5. The method of claim 1, wherein compressing fluid comprises use of a compressor.

6. The method of claim 5, further comprising controlling the compressor based on a temperature of the liquid or gas or both external to the tool.

7. The method of claim 1, wherein the exposing the fluid to a surface in communication with the liquid or gas or both external to the equipment comprises a heat exchanger.

8. The method of claim 1, wherein the allowing the fluid to expand comprises the fluid expanding in a valve and/or an orifice.

9. The method of claim 8, further comprising designing the valve and/or orifice based on the temperature of the liquid or gas or both external to the tool.

10. The method of claim 1, wherein the oilfield services tool is a drilling, measurement, observation, or completions tool.

11. The method of claim 1, further comprising repeating the passing, compressing, exposing, and allowing the fluid to expand.

12. An oilfield services tool comprising:

a tool housing;

a tool chassis that comprises a body located within the tool housing;

electronic components mounted to at least one outer face on the body of the tool chassis;

at least one flow line that passes through the body of the tool chassis, wherein the flow line passes a fluid and heat is conducted from the body of the tool chassis to the fluid;

a compressor that accepts fluid from the flow line of the tool chassis after the fluid has passed through the body of the tool chassis;

a heat exchanger that accepts fluid from the compressor and that exchanges heat from the fluid to the surrounding fluid or formation; and a valve or orifice to accept fluid from the compressor and to return fluid to the flow line of the tool chassis;

wherein the apparatus is configured to use the vapor compression cycle to cool the electronic components.

13. The oilfield services tool of claim 12, wherein the tool is a drilling, measurement, observation, or completions tool.

14. The oilfield services tool of claim 12, wherein the fluid comprises water.

15. The oilfield services tool of claim 12, further comprising:

a controller for controlling the compressor, wherein the controller uses a temperature measurement of the surrounding fluid or formation to control the compressor.

16. The method of claim 1, wherein a compressor is used to compress the fluid and the compressor is controlled using a temperature of the liquid or gas or both external to the tool.

17. The method of claim 16, wherein the compressor comprises a variable frequency drive.

* * * * *